US005106413A

United States Patent [19]

Takehawa

[11] Patent Number: 5,106,413

[45] Date of Patent: Apr. 21, 1992

[54] MEASUREMENT METHOD, ADJUSTMENT METHOD AND ADJUSTMENT SYSTEM FOR THE CONCENTRATIONS OF INGREDIENTS IN ELECTROLESS PLATING SOLUTION

[75] Inventor: Hiroko Takehawa, Yokohama, Japan

[73] Assignee: Hitachi, Ltd., Tokyo, Japan

[21] Appl. No.: 649,697

[22] Filed: Feb. 1, 1991

[30] Foreign Application Priority Data

Feb. 1, 1990 [JP] Japan ..... 2-23467

[51] Int. Cl.[5] ..... C23C 18/16; C23C 18/44

[52] U.S. Cl. ..... 106/1.22; 106/1.23; 106/1.26

[58] Field of Search ..... 106/1.23, 1.26, 1.22

[56] References Cited

U.S. PATENT DOCUMENTS

| | | | |
|---|---|---|---|
| 3,770,464 | 11/1973 | Dutkewych et al. | 106/1.26 |
| 4,229,218 | 10/1980 | Gulla et al. | 106/1.26 |
| 4,276,323 | 6/1981 | Oka et al. | 106/1.23 |
| 4,324,589 | 4/1982 | Gulla et al. | 106/1.22 |
| 4,565,575 | 1/1986 | Cardin et al. | 106/1.22 |

FOREIGN PATENT DOCUMENTS

| | | | |
|---|---|---|---|
| 213678 | 9/1988 | Japan | 106/1.23 |

*Primary Examiner*—William R. Dixon, Jr.

*Assistant Examiner*—Helene Klemanski

*Attorney, Agent, or Firm*—Antonelli, Terry, Stout & Kraus

[57] ABSTRACT

Disclosed herein are a method for measuring the concentration of one or more ingredients in an electroless plating solution containing at least one metal ingredient, anions and a reducing agent, and concentration adjustment method and system making use of the method. The method features measurement of the concentration of the reducing agent after replacing the anions with anions of a different type which does not affect the measurement of the concentration of the reducing agent. The measurement of the concentration of the metal ingredient can be conducted by atomic absorption spectrometry or plasma spectro.metry, while that of the reducing agent can be performed by ultraviolet absorption spectroscopy or electrochemical quantitative analysis. Preferably, the measurement of the concentrations of one or more ingredients in the electroless plating solution, calibration of concentration measuring instruments and the replacement of the anions with the anions of the different type are performed under sequence control according to a preset sequence program, and the concentrations of the metal ingredient and the reducing agent are determined by computation.

12 Claims, 9 Drawing Sheets

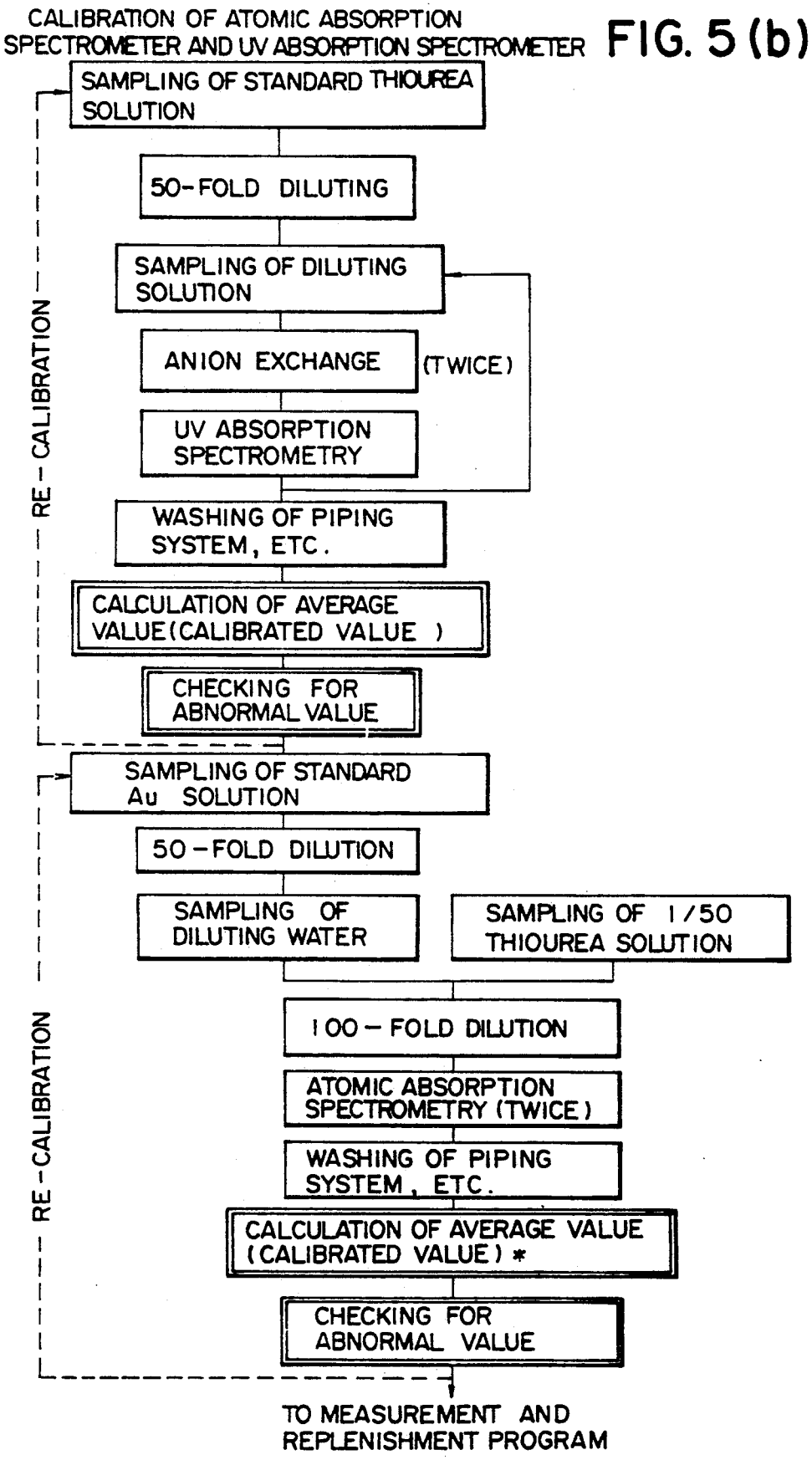
CALIBRATION OF ATOMIC ABSORPTION SPECTROMETER AND UV ABSORPTION SPECTROMETER
FIG. 5 (b)
SAMPLING OF STANDARD THIOUREA SOLUTION
50-FOLD DILUTING
SAMPLING OF DILUTING SOLUTION
ANION EXCHANGE
(TWICE)
UV ABSORPTION SPECTROMETRY
WASHING OF PIPING SYSTEM, ETC.
CALCULATION OF AVERAGE VALUE (CALIBRATED VALUE )
CHECKING FOR ABNORMAL VALUE
RE-CALIBRATION
SAMPLING OF STANDARD Au SOLUTION
50-FOLD DILUTION
SAMPLING OF DILUTING WATER
SAMPLING OF 1/50 THIOUREA SOLUTION
100-FOLD DILUTION
ATOMIC ABSORPTION SPECTROMETRY (TWICE)
WASHING OF PIPING SYSTEM, ETC.
CALCULATION OF AVERAGE VALUE (CALIBRATED VALUE) *
CHECKING FOR ABNORMAL VALUE
RE-CALIBRATION
TO MEASUREMENT AND REPLENISHMENT PROGRAM CALCULATION OF CONCENTRATION SHOULD BE PERFORMED BY PROPORTIONAL CALCULATION BASED ON THE CALIBRATED VALUE *

MEASUREMENT METHOD, ADJUSTMENT METHOD AND ADJUSTMENT SYSTEM FOR THE CONCENTRATIONS OF INGREDIENTS IN ELECTROLESS PLATING SOLUTION

BACKGROUND OF THE INVENTION

1. Field of the Invention

The present invention relates to a method and system for the measurement of the concentrations of a reducing agent and a metal ingredient contained in an electroless plating solution. This invention is also concerned with a method for the automatic adjustment of the concentrations of ingredients in an electroless plating solution and a system for practicing the automatic adjustment method.

2. Description of the Related Art

Various methods have heretofore been proposed for the measurement of the concentration of a metal ingredient in an electroless plating solution, including the absorptiometric measurement making use of the color of metal ions itself as proposed in Publication of Unexamined Japanese Patent Application (KOKAI) No. 63-121668, the use of fluorescent x-ray analysis as disclosed in Publication of Unexamined Japanese Patent Application (KOKAI) No. 60-164239, and the adoption of potentiometric titration as described in Publication of Unexamined Japanese Patent Application (KOKAI) No. 62-14053.

Further, regarding the measurement of the concentration of a reducing agent such as formaldehyde in an electroless plating solution, there is a method in which the concentration of the reducing agent is determined from the quantity of electrocity required for the oxidation of the reducing agent as disclosed in Publication of Unexamined Japanese Patent Application (KOKAI) No. 53-9235.

In electroless plating, both metal ingredient and reducing agent are consumed out of ingredients of a plating solution as the plating proceeds. Further, the velocity of electroless plating, namely, the deposition rate depends heavily on the concentrations of the individual ingredients in the plating solution. To maintain the deposition rate, it is necessary to measure the concentrations of both the metal ingredient and the reducing agent and to replenish their consumed amounts from time to time. Among the above conventional techniques, the method making use of the inherent color of a metal ingredient and the method employing potentiometric titration are however accompanied by the problem that they can be applied to only a limited type of electroless plating solutions to measure the concentrations of their metal ingredients and they hence do not have broad applicability. Turning next to the measuring method for the concentration of a reducing agent, nothing has been taken into consideration for electroless plating solutions which contain a great deal of reducing ions, such as $SO_3^{2-}$, $S_2O_3^{2-}$, as a complexing agent in addition to the reducing agent.

There have been known, for example, non-cyanide electroless gold plating solutions which contain gold ions as metal ions, thiosulfate ions ($S_2O_3^{2-}$) and sulfite ions ($SO_3^{2-}$) as ligands for forming complexes with the gold ions, and thiourea as a reducing agent. An attempt to determine the concentration of thiourea as the reducing agent from the quantity of electrocity required for its oxidation however does not lead to any accurate measurement of the concentration of the reducing agent because the sulfite ions and thiosulfate ions are oxidized at the same time. Thiourea as a reducing agent can be analyzed by the sodium nitroprusside reaction method, while sulfite ions and thiosulfate ions can be analyzed by ion chromatography. Sodium nitroprusside is however prone to decomposition and the measurement is time-consuming. The sodium nitroprusside reaction method is therefore not suitable for the analysis in actual production although it may be used in laboratory-level analyses.

As has been described above, in the field of electroless plating technology, no technique has been developed yet to permit accurate measurement of the concentrations of ingredients in a plating solution in actual production. This has therefore imposed the problem that control of the concentration of one or more ingredients cannot be performed properly.

SUMMARY OF THE INVENTION

An object of the present invention is to overcome the above-described problems of the conventional art and to provide a method for adjusting the concentrations of a reducing agent and a metal ingredient in an electroless plating solution by measuring with ease and high accuracy the concentrations of such ingredients in the electroless plating solution even when reducing ions such as $SO_3^{2-}$, $S_2O_3^{2-}$ and/or the like are contained in the form of a complexing agent at a high concentration in the electroless plating solution and also to provide a system for practicing the method.

Another object of the present invention is to provide a method for always controlling the concentrations of a reducing agent and a metal ingredient in an electroless plating solution within prescribed ranges, respectively and hence permitting automatic control of electroless plating even when reducing ions such as $SO_3^{2-}$, $S_2O_3^{2-}$ and/or the like are contained in the form of a complexing agent at a high concentration in the electroless plating solution and also to provide a system for practicing the method.

In one aspect of the present invention, there is thus provided a method for measuring the concentration of at least one ingredient in an electroless plating solution containing at least one metal ingredient, anions and a reducing agent, which comprises: measuring the concentration of the reducing agent after replacing the anions with anions of a different type which give no disturbance to the measurement of the concentration of the reducing agent.

In another aspect of the present invention, there is also provided a method for measuring the concentrations of ingredients in an electroless plating solution containing at least one metal ingredient, anions and a reducing agent, which comprises: measuring the concentration of the reducing agent after replacing the anions with anions of a different type which give no disturbance to the measurement of the concentration of the reducing agent; and measuring the concentration of the metal ingredient by atomic absorption spectrometry or plasma spectrometry.

Desirably, the concentration of the reducing agent can be measured by ultraviolet absorption spectrometry or electrochemical quantitative analysis.

In a further aspect of the present invention, there is also provided a method for measuring the concentrations of ingredients in an electroless plating solution containing at least one metal ingredient, anions and a reducing agent, which comprises: performing, under sequence control according to a preset sequence program, the measurement of the concentration of the metal ingredient in the plating solution and calibration of a metal-ingredient-concentration measuring means adapted to be used for the measurement of the metal ingredient, the measurement of the concentration of the reducing agent in the plating solution and calibration of a reducing-agent-concentration measuring means adapted to be used for the measurement of the reducing agent, and replacement of the anions with anions of a different type which give no disturbance to the measurement of the concentration of the reducing agent; and determining the concentrations of the metal ingredient and the reducing agent in the plating solution from measurement and calibration values obtained by the measurement and the calibration, respectively.

In a still further aspect of the present invention, there is also provided a method for adjusting the concentration of an electroless plating solution containing at least one metal ingredient, anions and a reducing agent, which comprises: replacement of the anions with anions of a different type which give no disturbance to measurement of the concentration of the reducing agent; determining, by computation, consumed amounts of the metal ingredient and the reducing agent from calibration and measurement values which have been obtained by calibration of a metal-ingredient-concentration measuring means adapted to measure the metal ingredient and calibration of a reducing-agent-concentration measuring means adapted to measure the reducing agent and also by measurement of the concentration of the metal ingredient with the metal-ingredient-concentration measuring means and measurement of the concentration of the reducing agent with the reducing-agent-concentration measuring means; and replenishing the plating solution with a replenisher containing the reducing agent and the metal ingredient in amounts corresponding to the consumed amounts, respectively.

In a still further aspect of the present invention, there is also provided a system for the measurement of the concentrations of ingredients in an electroless plating solution containing at least one metal ingredient, anions and a reducing agent, which comprises: an ion exchange means for replacing the anions with anions of a different type which give no disturbance to the measurement of the concentration of the reducing agent; a means for regenerating the ion exchange means with a solution containing anions of the different type; a means for measuring the concentration of the reducing agent; a means for measuring the concentration of the metal ingredient; a sequence control means for controlling calibration of the reducing-agent-concentration measuring means and the metal-ingredient-concentration measuring means and the measurement of the ingredients in the plating solution by the reducing-agent-concentration measuring means and the metal-ingredient-concentration measuring means; and an arithmetic control means for computing the concentrations of the metal ingredient and the reducing agent in the plating solution from measurement and calibration values obtained by the measurement and the calibration, respectively.

In a still further aspect of the present invention, there is also provided a system for the adjustment of the concentrations of ingredients in an electroless plating solution containing at least one metal ingredient, anions and a reducing agent, which comprises: an ion exchange means for replacing the anions with anions of a different type which give no disturbance to the measurement of the concentration of the reducing agent; a means for regenerating the ion exchange means with a solution containing anions of the different type; a means for measuring the concentration of the reducing agent; a means for measuring the concentration of the metal ingredient; a sequence control means for controlling operations of the reducing-agent-concentration measuring means and the metal-ingredient-concentration measuring means; an arithmetic control means having a means for calculating consumed amounts of the reducing agent and the metal ingredient from the differences between the concentrations of the reducing agent and the metal ingredient and their corresponding preset concentrations and a means for feeding a replenisher containing the reducing agent and the metal ingredient in amounts corresponding to the consumed amounts, respectively.

In a still further aspect of the present invention, there is also provided electroless plating system suitable for use in conducting electroless plating in an electroless plating solution containing at least one metal ingredient, anions and a reducing agent, which comprises: a plating bath, a means for measuring the concentration of the electroless plating solution, a means for replenishing the electroless plating solution, a sequence control means, and an arithmetic control means; wherein, the plating-solution-concentration measuring means has an ion exchange means for replacing the anions with anions of a different type which give no disturbance to the measurement of the reducing agent, a means for measuring the concentrations of the reducing agent and a means for measuring the concentration of the metal ingredient, the sequence control means controls operation of the plating-solution-concentration measuring means, and the arithmetic control means has a means for calculating consumed amounts of the reducing agent and the metal ingredient from the differences between the measured concentrations of the reducing agent and the metal ingredient and their corresponding preset concentrations and a means for feeding a replenisher, which contains the reducing agent and the metal ingredient in amounts corresponding to the respective consumed amounts, from the plating solution replenishing means to the plating bath.

In a still further aspect of the present invention, there is also provided a concentration control system comprising: a means for measuring the concentration of a metal ingredient contained in a solution; a means for measuring the concentration of a non-metal ingredient contained in the solution; and a means having a function of controlling operations of the metal-ingredient-concentration measuring means and the non-metal-ingredient-concentration measuring means and a function of feeding a replenisher containing the metal ingredient in an amount corresponding to a consumed amount of the metal ingredient on the basis of the difference between the measured concentration of the metal ingredient and its preset concentration and another replenisher containing the non-metal ingredient in an amount corresponding to a consumed amount of the non-metal ingredient on the basis of the difference between the measured concentration of the non-metal ingredient and its preset concentration.

Preferably, the metal-ingredient-concentration measuring means can be an atomic absorption spectrometer or a plasma spectrometer.

More preferably, the non-metal-concentration measuring means may comprise an anion exchange apparatus and an ultraviolet absorption spectrometer or an electrochemical quantitative analyzer.

DETAILED DESCRIPTION OF THE INVENTION AND PREFERRED EMDOBIMENTS

Figure 6:
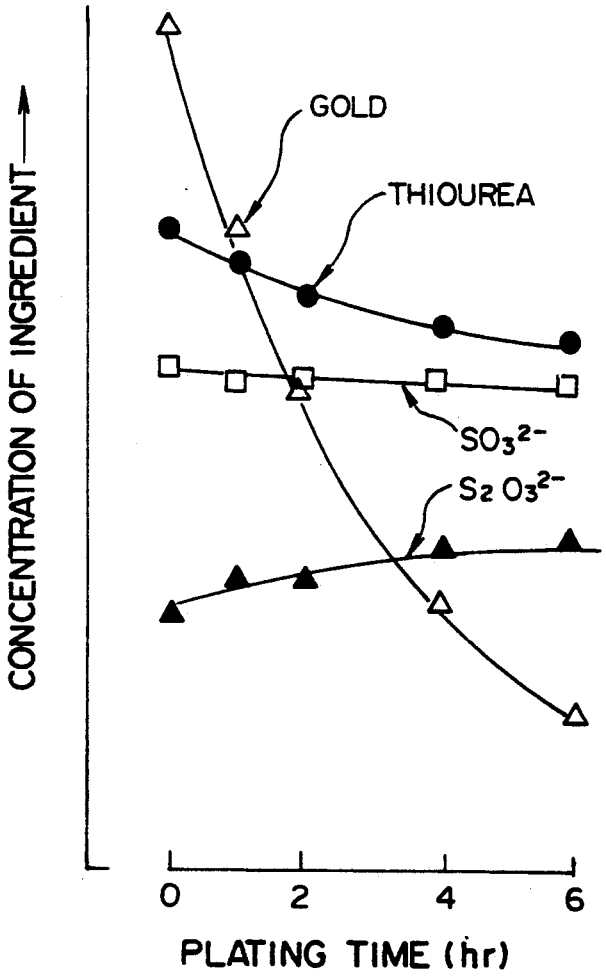
FIG. 6 is a diagrammatic representation of time-dependent variations in the concentrations of ingredients when electroless plating was conducted using an electroless non-cyanide plating solution without addition of a replenisher.

The present invention will hereinafter be described in detail, taking by way of example an electroless non-cyanide gold plating solution which contains gold ions, sulfite ions, thiosulfate ions and thiourea. FIG. 6 illustrates variations in the concentrations of ingredients when plating was caused to proceed without adding the ingredients of the plating solution as a replenisher. On the other hand, FIG. 7 shows variations in the concentrations of ingredients and also variations in depostion rate when ingredients, which progressively decreased as the plating proceeded, were added as a replenisher and the concentrations of the ingredients of the plating solution were maintained substantially constant.

In FIG. 6, the concentration of each ingredient is plotted along the axis of ordinates while plating time is plotted along the axis of abscissas.

As is apparent from FIGl. 6, the concentrations of gold ions and thiourea decrease as plating proceeds although the concentrations of sulfite ions and thiosulfate ions remain unchanged. As a result, the deposition rate gradually decreases.

Figure 7:
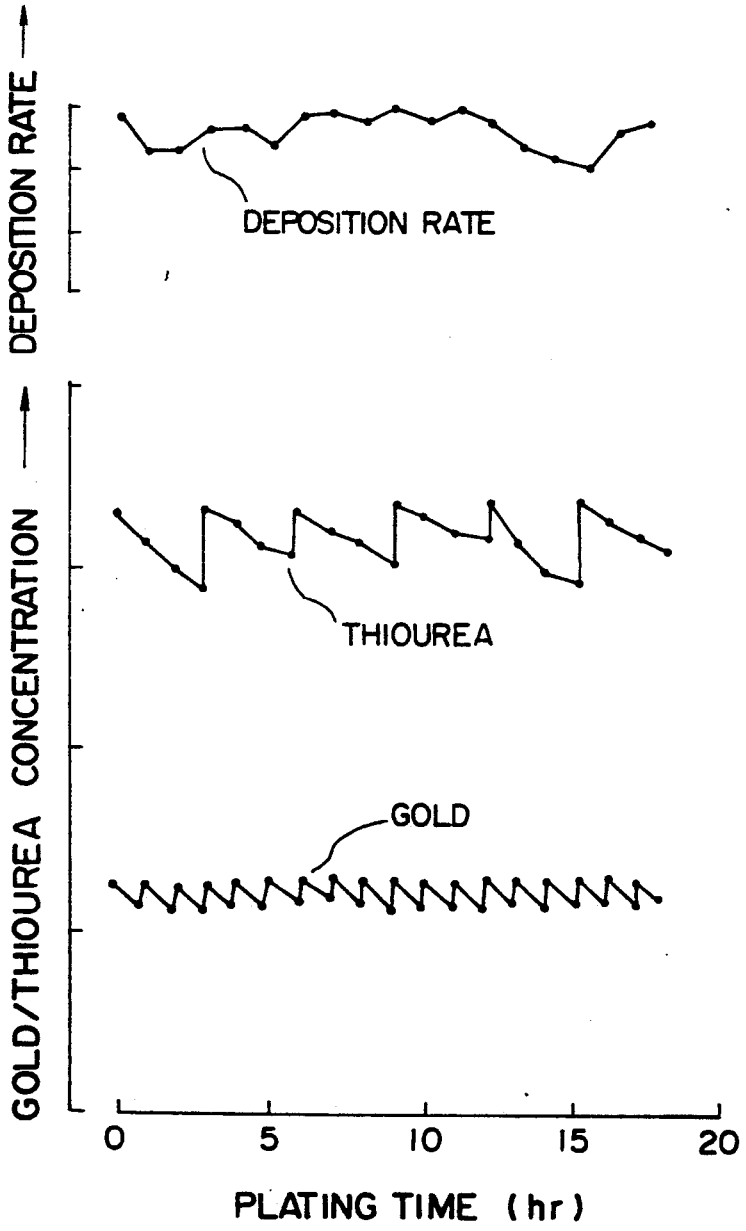
FIG. 7 is a diagrammatic representation of time-dependent variations in the concentrations of ingredients and also time-dependent variations in deposition rate when electroless plating was conducted using an electroless non-cyanide plating solution while adding a replenisher along as the plating proceeded.

The concentration of each ingredient and plating time are also plotted along the axis of ordinates and the axis of abscissas, respectively in FIG. 7. Also shown are variations in depostion rate with the passage of plating time.

As is depicted in FIG. 7, the deposition rate can be maintained within a prescribed range over a long period of time when the amounts of gold and thiourea consumed due to the progress of plating are measured at present time intervals and the consumptions are replenished.

As has been described above, out of ingredients of an electroless plating solution, both a metal ingredient and a reducing agent are consumed in electroless plating as the plating proceeds. Moreover, the electroless deposition rate heavily depends on the concentrations of the ingredients in the plating solution. To maintain the deposition rate constant, it is therefore necessary to measure the concentrations of both the metal ingredient and the reducing agents and replenish their consumptions from time to time.

For measurement of the concentrations of the ingredients in the plating solution, reducing ions contained in the plating solution are preliminarily eliminated.

More specifically, when an anion exchange material in an ion exchanger is regenerated, for example, into a chlorine ion form by using KCl (potassium chloride) and a certain amount of a sample electroless plating solution is then poured into the ion exchanger, sulfite ions, thiosulfate ions, complex ions with such sulfite and/or thiosulfate ions coordinated on metal ions, and the like are captured by the anion exchange material because of their greater affinity to the anion exchange material compared to chlorine ions, whereby an equivalent amount of chlorine ions are eluted instead.

On the other hand, a reducing agent such as thiourea or formaldehyde contained in the sample electroless plating solution is not captured by the anion exchange material owing to its nonionic nature, so that the reducing agent is allowed to flow out as it is.

Reducing ions contained in a plating solution can therefore be eliminated as described above.

Where the reducing agent contained in the plating solution shows absorption of ultraviolet rays like thiourea, the concentration of thiourea can be measured by an ultraviolet absorption detector (spectrometer) provided downstream of the anion exchanger. Where the reducing agent does not show absorption of ultraviolet rays like formaldehyde, the concentration of formaldehyde can be calculated based on the quantity of electrocity required for its oxidation.

As the anion exchange material, an anion exchange resin, an anion exchange membrane or the like can be employed. Exemplary regenerating solutions for the anion exchange material include, in addition to a KCl solution, solutions of other salts of chlorine ions, namely, NaCl solutions, $NH_4Cl$ solution, etc. It is also possible to regenerate the anion exchange material with a solution of anions having small affinity to the anion exchange material other than chlorine ions, for example, with an $NaHCO_3$ or $KHCO_3$ solution so that the anion exchange material can be converted to an $HCO_3-$ form for reutilization.

On the other hand, the concentration of the metal ingredient contained in the plating solution can be measured by an atomic absorption spectrometer.

The concentrations of metal ions and a reducing agent, which concentrations decrease as plating proceeds, can be measured by the above measuring method.

The arithmetic control means determines the amounts of ingredients consumed with the progress of plating from the differences between the concentrations of the ingredients in the plating solution and their preset values and then calculates the amounts to be replenished. In accordance with information on the consumed amounts of the ingredients, the ingredients are replenished from time to time in amounts corresponding to the consumed amounts from replenisher tanks, respectively, so that the concentrations of the individual ingredients in the plating solution are always controlled within their corresponding prescribed ranges. As a result, the deposition rate can be maintained constant.

The method of the present invention for the measurement of the concentration of at least one ingredient in a plating solution permits high-accuracy measurement of the concentration of the reducing agent in the plating solution because the concentration of the reducing agent can be measured after replacing anions, which are also contained in the plating solutin, with anions of a different type which give no disturbance to the measurement of the reducing agent.

Further, the addition of a function of computing the concentrations of ingredients in a plating solution and replenishing the ingredients to the system making used of the above method makes it possible to always control the concentrations of the ingredients in the plating solution within their corresponding prescribed ranges, thereby leading to the attainment of automatic control of the plating solution.

The concentration control system of the present invention, which is equipped with the metal-ingredient-concentration meausring unit, the non-metal-ingredient-concentration measuring unit and the arithmetic control unit, can measure the concentrations of both the metal ingredient and the non-metal ingredient in the plating solution. When a measurement value is found to fall outside its preset control range, the arithmetic control unit functions to add a replenisher from a corresponding replenisher tank so that the concentration of each ingredient in the plating solution can be maintained within its control range.

The present invention will hereinafter be described in further detail on the basis of the preferred embodiments illustrated in the accompanying drawings. It should however be borne in mind that the present invention is not limited to or by such embodiments.

EXAMPLE 1

Figure 1:
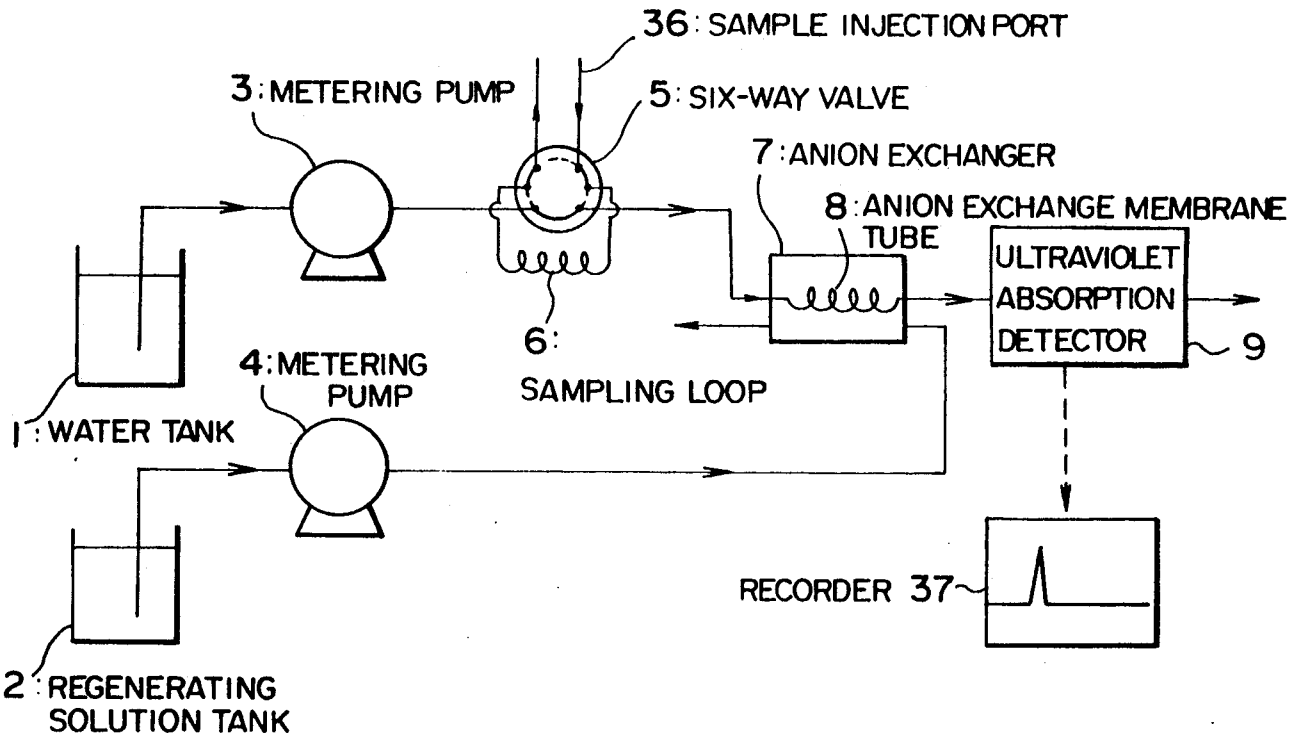
FIG. 1 is a system diagram showing the construction of one embodiment of a concentration measuring system useful in a concentration measuring method of the present invention.

FIG. 1 schematically illustrates one embodiment of a system useful in the measurement of the concentration of thiourea in an electroless plating solution containing $KAuCl_4$, $Na_2SO_3$, $Na_2S_2O_3$ and thiourea as principal ingredients.

Measurement of the concentration in this example is conducted using a measuring system which, as shown in FIG. 1, is equipped with a water tank 1 for holding water ($H_2O$) as a carrier liquid, a regenerating solution tank 2 for holding a 0.2N KCl solution as a regenerating solution, metering pumps 3,4, a six-way valve 5, a sampling loop 6, a sample injection port 36, an anion exchanger 7, an anion exchange membrane tube 8, an ultraviolet absorption detector (spectrometer) 9 and a recorder 37.

The anion exchanger 7 is in the form of a double-walled tube with the anion exchange membrane tube 8 provided internally. The 0.2N KCl regenerating solution is fed at a flow rate of 2 ml/min by the metering pump 4 from the regenerating solution tank 2 to an outer cylinder portion of the anion exchange membrane tube 8, whereby the anion exchange membrane tube 8 always remains in the regenerated form, namely, in the form of a chlorine ion form. The carrier liquid ($H_2O$) is always fed at a flow rate of 2 ml/min from the water tank 1 to the ultraviolet absorption detector 9 through the inside of the anion exchange membrane tube 8.

When a fiftyfold dilute solution of the sample plating solution is injected through the sample injection port 36 in the sate that the six-way valve 5 is in the connection state indicated by solid lines in FIG. 1, the fiftyfold dilute solution is sampled in a given constant amount in the sampling loop 6.

When the six-way valve 5 is next switched over to achieve the connection indicated by dotted lines in the same figure, the carrier liquid ($H_2O$) is caused to flow through the sampling loop 6 so that the fiftyfold dilute solution sampled in the sampling tube 6 is conveyed from the anion exchange membrane tube 8 to the ultraviolet absorption detector 9.

Sulfite ions, thiosulfate ions, complex gold ions such as $[Au(S_2O_3)_2]^{3-}$ and the like, which are contained in the fiftyfold dilute solution, are captured on the anion exchange membrane, and chlorine ions are eluted instead. These cholrine ions are then conveyed by the carrier liquid to the ultraviolet absorption detector 9. Thiourea as the reducing agent is a nonionic substance so that it is conveyed to the ultraviolet absorption detector 9 without being captured inside the anion exchange membrane tube 8.

The measuring wavelength of the ultraviolet absorption detector 9 is set at 240 nm. Using this ultraviolet absorption detector 9, the concentration of thiourea in the fiftyfold dilute solution of the sample plating solution can be measured on the basis of the principle to be described below.

Figure 2:
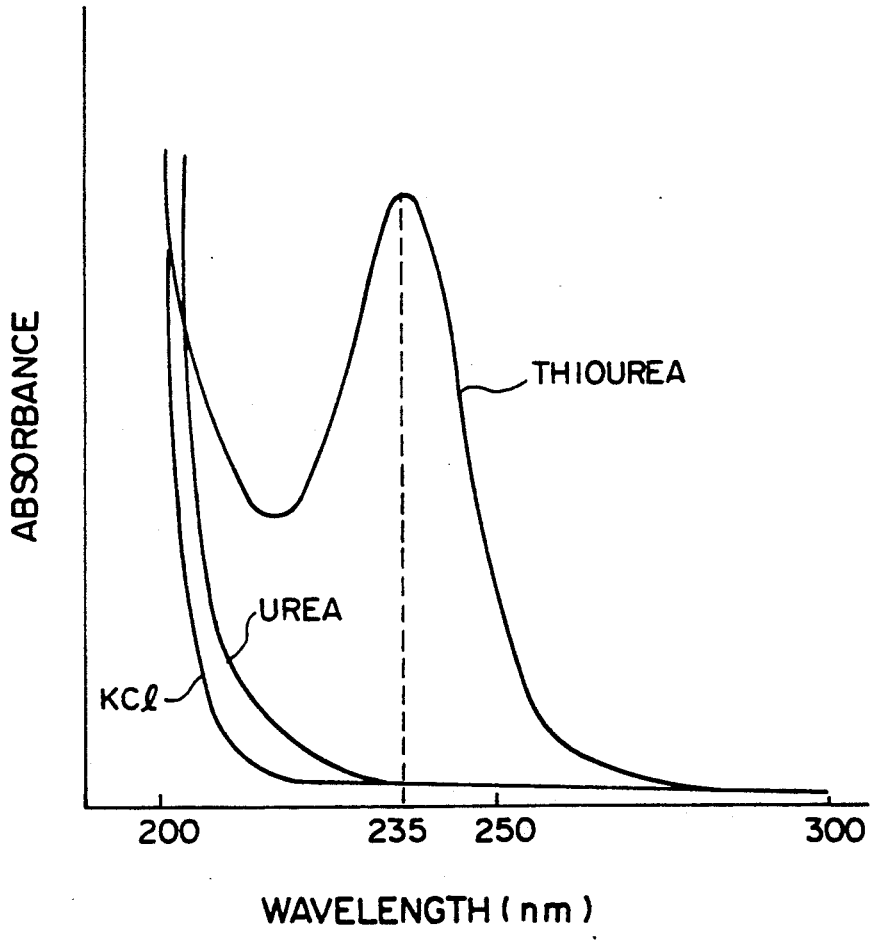
FIG. 2 shows ultraviolet spectra of thiourea, urea and KCl.

Namely, the ultraviolet absorption spectrum of thiourea has a maximum absorption at 235 nm as is clear from the absorption curve shown in FIG. 2. On the other hand, no absorption of ultraviolet rays is exhibited by chlorine ions eluted by ion exchange of anions such as sulfite ions, thiosulfate ions.

As the plating proceeds, thiourea is oxidized and urea is formed. This urea does not show ultraviolet absorption either as shown in FIG. 2.

Setting of the wavelength of the ultraviolet absorption detector 9 at 235–240 nm therefore makes it possible to measure the absorbance by thiourea alone in the fiftyfold dilute solution.

Calculation of the concentration of thiourea in the plating solution can be effected in the following manner. Namely, using a standard thiourea solution of a given concentration, its absorbance is measured in a similar manner as described above. The concentration of thiourea in the plating solution can then be determined by proportional calculation on the basis of the absorbance of the standard thiourea solution.

Instead of using the anion exchange membrane tube 8, the anion exchanger 7 may be of such a structure that two flat anion exchange membranes are superimposed one over the other as layers, a sample plating solution whose thiourea concentration is to be measured is caused to flow through the inside, and a KCl solution as a regenerating solution is caused to flow outside the membranes.

EXAMPLE 2

Figure 3:
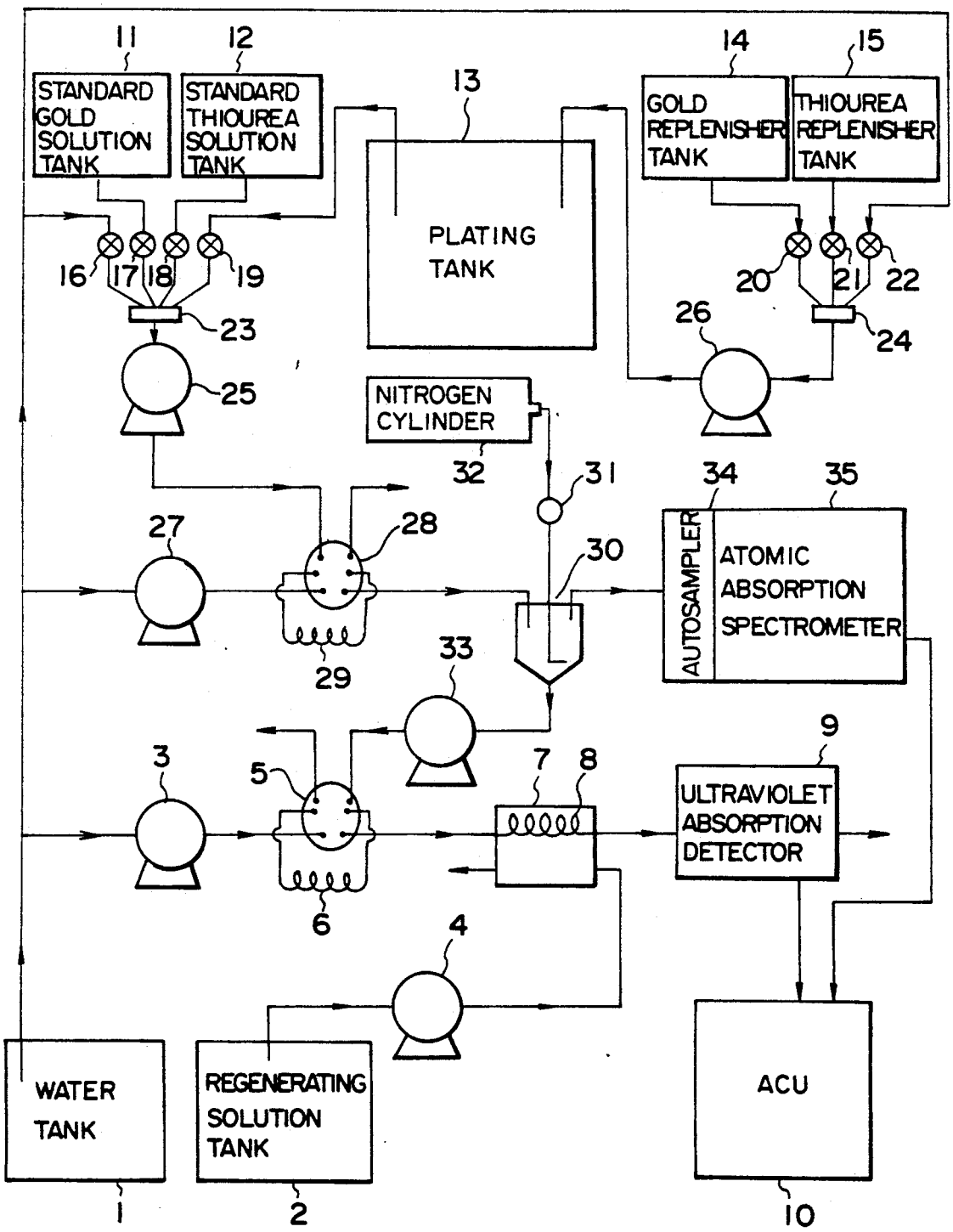
FIG. 3 is a system diagram showing the construction of one embodiment of a concentration adjusting system useful in a concentration adjusting method of the present invention.

FIG. 3 shows the construction of one embodiment of an ingredient concentration adjusting system as applied to an electroless plating system.

In this example, adjustment of the concentrations of ingredients in an electroless plating solution containing $KAuCl_4$, $Na_2SO_3$, $Na_2S_2O_3$, thiourea and the like as principal ingredients is conducted using the above system.

The ingredient concentration adjusting system in this example is equipped, as depicted in FIG. 3, with a water tank 1 for holding water as a carrier liquid, a regenerating solution tank 2 holding a 0.2N KCl solution as a regenerating solution, metering pumps 3,4, a six-way valve 5, a sampling loop 6, an anion exchanger 7, an anion exchange membrane tube 8 and an ultraviolet absorption detector 9. They are of substantially the same constructions as their corresponding elements in the above-described system for the measurement of the concentration of a reducing agent, said system being illustrated in FIG. 1.

The ingredient concentration adjusting system in this example is additionally equipped with an atomic absorption spectrometer 35 as a means for measuring the concentration of a gold ingredient in a plating solution and also with an arithmetic control unit (hereinafter abbreviated as "ACU") 10 to be described subsequently.

The ingredient concentration adjusting system in this example is provided, as means for adjusting the concentrations of ingredients in a plating solution inside a plating tank 13, with a water tank 1, a gold replenisher tank 14 and a thiourea replenisher tank 15. Also provided are a standard gold solution tank 11 and a standard thiourea solution tank 12, which are employed to hold calibration solutions to be used for the calibration of the ultraviolet absorption detector 9 and the atomic absorption spectrometer 35.

A piping system which connects the individual tanks with the ultraviolet absorption detector 9 and the atomic absorption spectrometer 35 include metering pumps 3,4,25–27,33, the six-way valve 5 with the sampling loop 6 connected thereto, a six-way valve 28 with a sampling loop 29 connected thereto, solenoid valves 16–22, manifolds 23,24, and a diluting tank 30.

A description will hereinafter be made of the piping system in this example.

The water tank 1 is connected to the solenoid valve 16, the standard gold solution tank 11 to the solenoid valve 17, the standard thiourea solution tank 12 to the solenoid valve 18, and the plating tank 13 to the solenoid valve 19. The solenoid valves 16–19 are connected to a suction side of the metering pump 25 via the manifold 23. By changing over the six-way valve 28, a discharge side of the metering pump 25 can be brought into communication with the sampling loop 29 of the six-way valve 28 or a discharge port to the outside.

One of the ports of the six-way valve 28 is connected to a discharge side of the metering pump 27. A discharge side of the metering pump 27 can be brought into communication with the sampling loop 29 of the six-way valve 28 or with the diluting tank 30 by changing over the six-way valve 28. To a suction side of the metering pump 27, the water tank 1 is connected.

The diluting tank 30 is connected to the atomic absorption spectrometer 35 equipped with an autosampler 34. The diluting tank 30 is connected to a nitrogen cylinder 32 by way of the solenoid valve 31, so that a solution fed for measurement to the diluting tank can be stirred in a nitrogen gas stream.

The diluting tank 30 is connected to a suction side of the metering pump 33, while a discharge side of the metering pump 33 is connected to one of the ports of the six-way valve 5. By changing over the six-way valve 5, the discharge side of the metering pump 33 can be brought into communication with the sampling loop 6 of the six-way valve 5 or with a discharge port to the outside.

Another one of the ports of the six-way valve 5 is connected to a discharge side of the metering pump 3. The discharge side of the metering pump 3 can be brought into communication with the sampling loop 6 of the six-way valve 5 or with the anion exchanger 7 by changing over the six-way valve. To a suction side of the metering pump 3, the water tank 1 is connected.

The regenerating solution tank 2 is connected to a suction side of the metering pump 4, while a discharge side of the metering pump 4 is connected to the anion exchanger 7.

The gold replenisher tank 14 is connected to the solenoid valve 20, the thiourea replenisher tank 15 to the solenoid valve 21, and the water tank 1 to the solenoid valve 22. The solenoid valves 20–22 are connected to a suction side of the metering pump 26 via the manifold 24. Arranged on a discharge side of the metering pump 26 is the plating tank 13. Namely, the solutions held in the metal replenisher tank 14 and the thiourea replenisher tank 15 can be supplied to the plating tank 13 via the metering pump 26.

ACU 10 performs on/off control of the metering pumps 3,4,25–27,33, open/close control of the solenoid valves 16–22,31, change-over control of the six-way valves 5,28, collection of data signals from the ultraviolet absorption detector 9 and atomic absorption spectrometer 35, and computation such as calculation of concentrations and calculation of amounts of the replenishers to be added.

In addition, ACU 10 also supplies necessary amounts of the gold and thiourea replenishers from the gold replenisher tank 14 and the thiourea replenisher tank 15 to the plating tank 13, whereby the concentrations of the ingredients in the plating solution are controlled within their corresponding preset ranges.

Although not shown in the figure, ACU 10 is constructed, for example, of a central processing unit (CPU), a memory for storing an operation program for CPU, computed data and the like, an output device for visually displaying the results of the computation, an I/O unit for inputting or outputting data, control signals and the like, an interface, an input device for externally giving instructions and evaluations, and the like.

A description will next be made of the operation of each element upon adjustment of the concentrations of the ingredients in the plating solution filled in the plating tank 13.

First, by an instruction from ACU 10, the solenoid valve 19 is opened and the metering pump 25 is driven, whereby a portion of the plating solution from the plating tank 13 is sampled in the sampling loop 29 of the six-way valve 28. The metering pump 27 is driven for a desired period of time to feed a prescribed amount of $H_2O$ (water) into the diluting tank 30. In the course of feeding of the water, the sample plating solution sampled in the sampling loop 29 is simultaneously fed into the diluting tank 30 by changing over the six-way valve 28.

The solenoid valve 31 is then opened so that nitrogen gas is allowed to flow for a short time into the diluting tank 30, whereby the sample solution is agitated. The plating solution is diluted to given extent in the diluting tank 30. A portion of the sample plating solution so diluted is delivered to the atomic absorption spectrometer 35 by the autosampler 34, so that the concentration of gold in the sample plating solution so diluted is measured.

In addition, by driving the metering pump 33, a portion of the sample plating solution so diluted is collected in the sampling loop 6 of the six-way valve 5. The concentration of thiourea in the sample plating solution so diluted is then measured by a similar method to that employed in the case of the measuring system for the concentration of a reducing agent, said system being shown in FIG. 1.

The change-over of these six-way valves, the drive of the metering pumps and the like are performed under automatic control by ACU 10.

Calibration of the atomic absorption spectrometer 35 and the ultraviolet absorption detector 9 is conducted at least once a day by a similar operation to the above-described measurement of the concentrations of the ingredients in the plating solution by adjusting the standard gold solution held in the standard gold solution tank 11 and the standard thiourea solution held in the standard thiourea solution tank 12 to the same concentrations as the control (preset) concentrations of gold and thiourea in the plating solution.

Calibration values obtained using the standard solutions are stored in ACU 10. By proportional calculation based on the calibration values, the concentrations of gold and thiourea in the plating solution are calculated. Further, based on their deviations from the corresponding preset concentrations, their amounts to be supplied are calculated.

Using the metering pump 26, the gold replenisher and thiourea replenisher are then supplied in the above-calculated amounts to the plating tank 13 from the gold replenisher tank 14 and the thiourea replenisher tank 15, respectively.

Namely, the replenishers can be supplied in amounts as needed by calculating the replenishing times of gold and thiourea based on the concentrations of gold and thiourea measured in the above-described manner, the concentrations of the gold replenisher and the thiourea replenisher, the amount of the plating solution in the plating tank 14 and the flow rate of the metering pump 26 and then successively opening the solenoid valves 20,21 for time periods as needed.

After the gold replenishment and the thiourea replenishment, the solenoid valve 22 is opened to wash the piping system with water.

EXAMPLE 3

Figure 4:
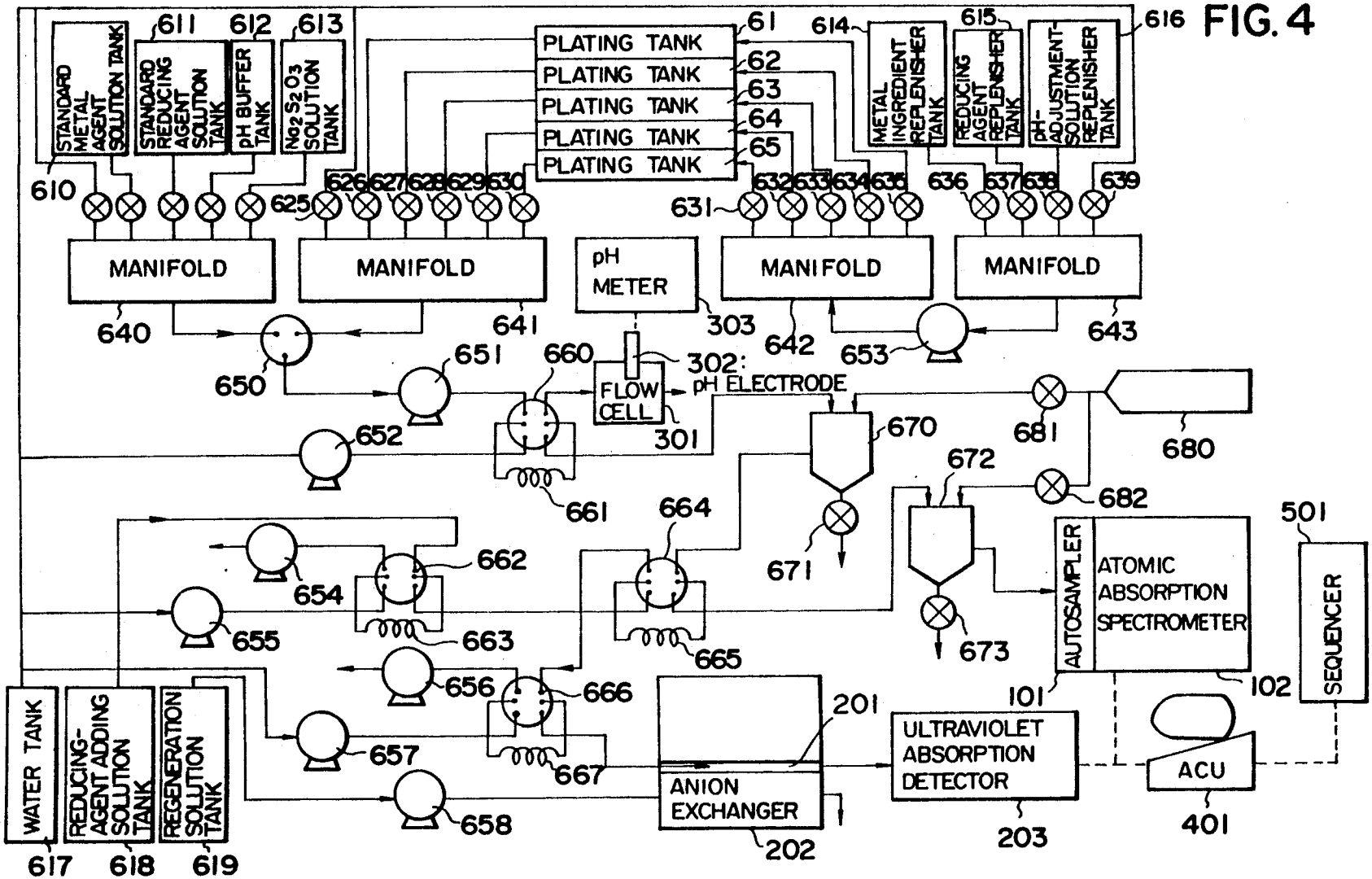
FIG. 4 is a system diagram showing one embodiment of a plating system in which the present invention has been incorporated to perform adjustment of a plating solution.

FIG. 4 illustrates one embodiment of the concentration control system, which is different from that shown in FIG. 3.

Similarly to the example described with reference to FIG. 3, the present example uses an atomic absorption spectrometer and an ultraviolet absorption detector as measuring instruments. The concentration control system employed in this example is however different in the additional provision of pH electrodes and also in the calibration method for the atomic absorption spectrometer and the construction of the piping system.

A description will hereinafter be made of exemplary control of the concentration of ingredients in an electroless plating solution which contains $KAuCl_4$ as a gold ingredient and $Na_2S_2O_3$, $Na_2SO_3$ and thiourea as ingredients having reducing properties.

The concentration control system employed in this example has an atomic absorption spectrometer 102 for measuring the concentration of the gold ingredient in the plating solution, an anion exchanger 202 equipped with an ion exchange membrane tube 201 for exchanging reducing anions such as sulfite ions and thiosulfate ions for non-reducing ions, an ultraviolet absorption detector (spectrometer) 203 for measuring the concentration of thiourea adapted to act as a reducing agent in the plating solution, pH electrodes 302, a pH meter 303, a sequencer 501 and control functions of performing calibration of the various measuring instruments and the measurement of the concentrations of the ingredients of the plating solution, and ACU 401 with an computation function of calcaluting consumed amounts of the ingredients in the plating solution and an arithmetic control function of controlling the supply of the consumed ingredients.

ACU 401 has substantially the same construction as ACU 10 described in Example 2.

The sequencer 501 includes a memory and a central processing unit (hereinafter abbreviated as "CPU"). The memory is adapted to store, as a program, programmed control procedures determined in advance, while CPU controls operations of solenoid valves, metering pumps, six-way valves and the like in accordance with the program stored in the memory.

The sequencer 501 is operated in accordance with instructions from ACU 401.

In FIG. 4, the solid lines indicate piping system while the broken lines designate transmission lines for signals. Signal transmission lines from the sequencer 501 are not shown in the figure.

The concentration control system used in this example also includes a standard metal solution tank 610 for a standard solution to be employed for the calibration of the atomic absorption spectrometer 102, a reducing-agent adding solution tank 618, a standard reducing agent solution tank 611 for holding a standard solution to be employed for the calibration of the ultraviolet absorption detector 203, a pH buffer tank 612 for holding a standard solution to be employed for the calibration of the pH electrodes 302, a metal ingredient replenisher tank 614 for replenishing metal ions consumed in plating, a reducing agent replenisher tank 615 for replenishing the reducing agent consumed in plating, and a pH-adjustment-solution replenisher tank 616 for pH adjustment.

A regenerating solution which is charged into the anion exchanger 202 to provide anions is held in a regenerating solution tank 619. Further, water to be used for the washing of the piping and also for the dilution of a sample solution is held in a water tank 617.

Employed as replenishers to be supplied to plating tanks 61–65 in accordance with instructions from ACU 401 are the solutions which are held in the metal ingredient replenisher tank 614, the reducing agent replenisher tank 615, the pH-adjustment-solution replenisher tank 616, respectively.

The plating tanks 61–65 shown in FIG. 4 may be incorporated in the system employed in this example or may be connected from the outside to the system via a piping system. It is also to be noted that the number of plating tanks is not limited to 5.

The individual measuring instruments and the respective solution tanks are connected by piping systems. Each piping system is provided with a solenoid valve, a manifold, a three-way or six-way valve and a metering pump as needed.

Solenoid valves 626–630 are connected to one sides of the plating tanks 61–65, respectively. A solenoid valve 625 is connected at one side thereof to the water tank 617. The other sides of the solenoid valves 625–630 are connected to one of the three ports of a three-way valve 650 via a manifold 641.

The standard metal ingredient solution tank 610, the standard reducing agent solution tank 611, the pH buffer tank 612, and an $Na_2S_2O_3$ solution tank 613 which will be described subsequently are connected at one sides thereof to solenoid valves 621–624, respectively. A solenoid valve 620 is connected at one side thereof to the water tank 617. The solenoid valves 620–624 are connected at the other sides thereof to one of the three ports of the three-way valve 650 via a manifold 640.

The remaining port of the three-way valve 650 is connected to a suction side of a sample-collecting metering pump 651. A discharge side of the sample-collecting metering pump 651 is connected to one of the six ports of a six-way valve 660 having a sampling loop 661. Connected to another port of the six-way valve 660 is a flow cell 301 with the pH electrodes 302 inserted therein. Each pH measured by the flow cell 301 is displayed at the pH meter 303.

A metering pump 652 whose suction side is connected to the water tank 617 is connected at a discharge side thereof to a diluting tank 670 via the six-way valve 660. Nitrogen gas is fed from a nitrogen gas cylinder 680 into the diluting tank 670 via a solenoid valve 681. A solenoid valve 671 is used upon disposal of a solution in the diluting tank 670.

A metering pump 656 is connected at a suction side to a piping which is adapted to collect a diluted sample. The piping extends from the diluting tank 670, through a six-way valve 664 having a sampling loop 665 and further through a six-way valve 666 having a sampling loop 667.

A metering pump 654 is connected at a suction side thereof to the reducing-agent adding solution tank 618 via a six-way valve 662 having a sampling loop 663. A metering pump 655 is connected at a suction side to the water tank 617 and at a discharge side to a diluting tank 672 via the three-way valves 662 and 664.

From the diluting tank 672, the sample to be measured is sent by an autosampler 101 to the atomic absorption spectrometer 102. Nitrogen gas is fed into the diluting tank 672 via a solenoid valve 682. A solenoid valve 673 is used upon disposal of a solution from the diluting tank 672.

A metering pump 657 is connected to the water tank 617. From a discharge side of the metering pump 657, a carrier liquid ($H_2O$) is fed at a constant rate to the ultraviolet absorption detector 203 by way of the six-way valve 666 and an ion exchange membrane tube 201. A metering pump 658 delivers the regenerating solution from the regenerating solution tank 619 to an outer cylinder of the anion exchanger 202.

Connected to a manifold 643 are the metal ingredient replenisher tank 614 via a solenoid valve 636, the reducing agent replenisher tank 615 via a solenoid valve 637, the pH-adjustment-solution replenisher tank 616 via a solenoid valve 638, and the water tank 617 via a solenoid valve 639. The manifold 643 is connected to a suction side of a replenishing metering pump 653. The replenishing metering pump 653 is connected at a discharge side thereof to one sides of the solenoid valves 631–635 via a manifold 642. The solenoid valves 631–635 are then connected to the plating tanks 61–65, respectively.

Operations, which are required for the calibration of the pH meter 303, the calibration of the atomic absorption spectrometer 102, the calibration of the ultraviolet absorption detector 203, the pH measurement of the plating solution, the concentration measurement of the reducing agent in the plating solution and the concentration measurement of the gold ingredient in the plating solution, respectively, are performed by the sequencer 501 in accordance with instructions from ACU 401.

Namely, the solenoid valves 620–630,671,673,681, 682, the metering pumps 651,652,654–658, the three-way valve 650 and the six-way valves 660,662,664,666 are successively actuated by instructions from the sequencer 501.

Figure 5A:
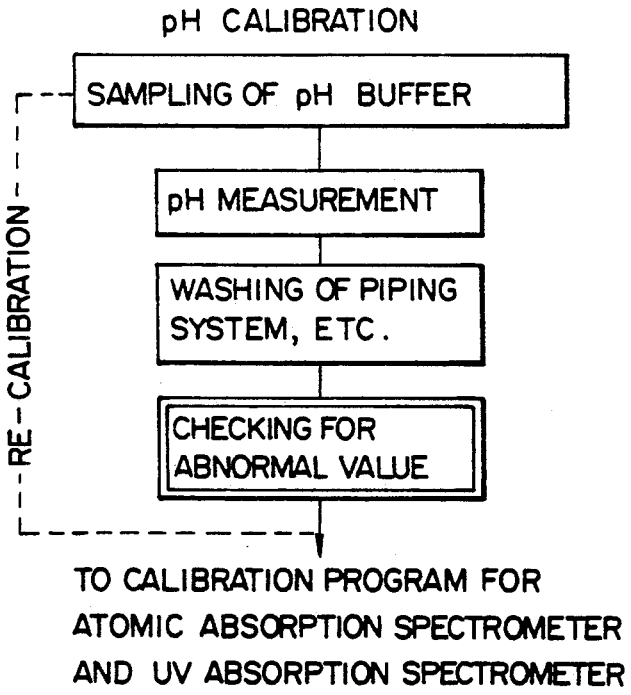
FIG. 5 is a flow chart showing the operation of an arithmetic control means employed in the embodiment depicted in FIG. 4.
Figure 5C:
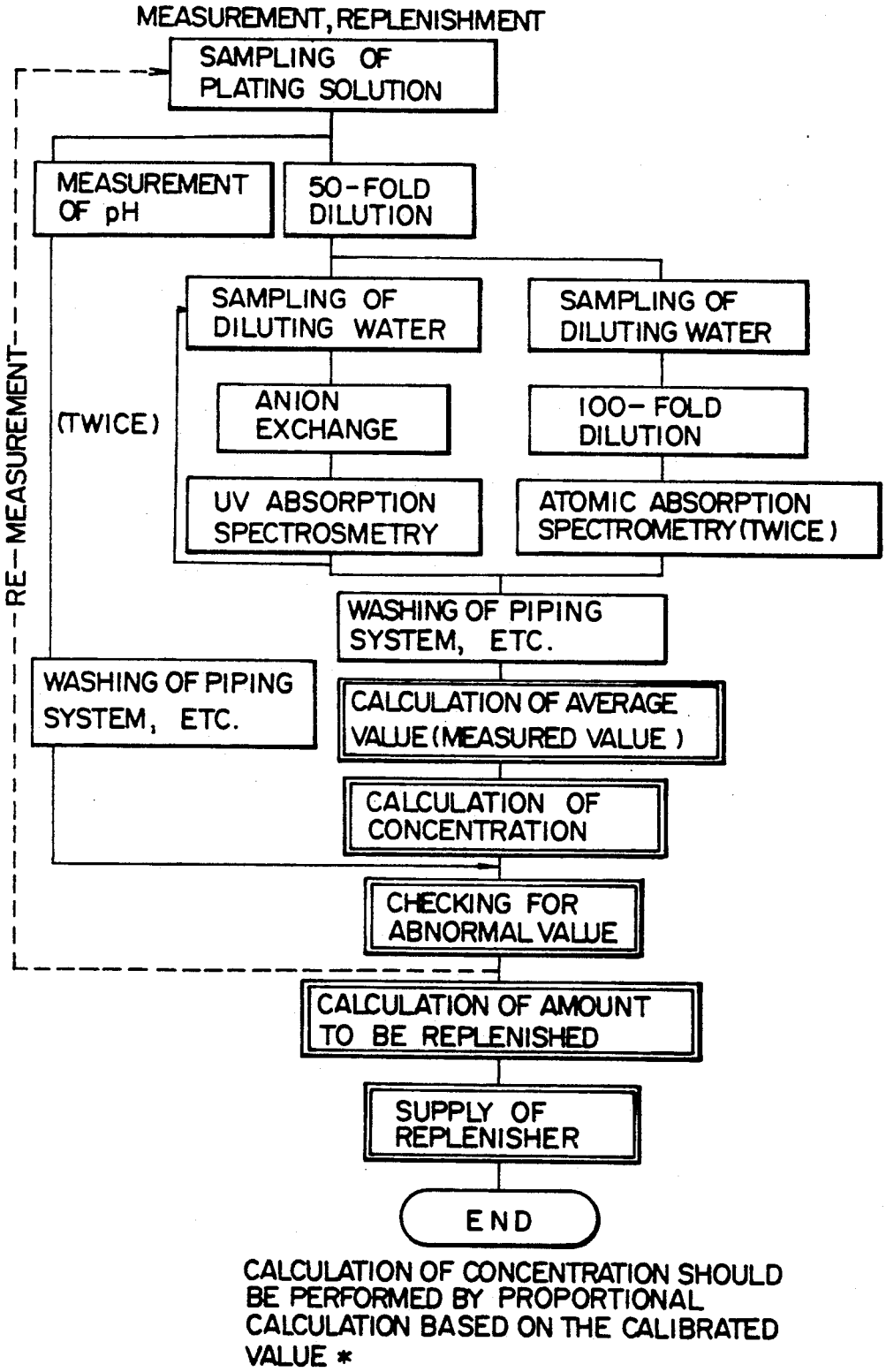

With reference to FIG. 5 which illustrates the flow of operations by the sequencer 501 and ACU 401, calibration methods for the individual measuring instruments and measuring methods for the concentrations of the ingredients in the plating solution will be described. In FIG. 5, the operations enclosed in the double frames are performed by ACU 401 and the other operations are conducted by the sequencer 501.

The calibration of the pH meter 303 is effected in the following manner.

A flow passage extending to the flow cell 301 via the solenoid valve 623, the three-way valve 650 and the six-way valve 660 is established. The metering pump 651 is driven to charge a sodium borate buffer (pH: about 9.2) from the buffer tank 612 into the flow cell 301. After the metering pump 651 is driven for a given period of time, the metering pump 651 is stopped. The pH of the pH buffer is then measured by the pH electrodes 302 inserted in the flow cell 301.

After the pH measurement, the solenoid valve 620 is opened and the metering pump 651 is driven to wash the pH electrodes 302, the flow cell 301, etc.

Tolerances of calibration values determined by repeated preliminary experiments are stored in advance in ACU 401, whereby any outliers of calibration values are tested.

Each tolerance is set beforehand at a suitable range by determining the range of variations of calibration values through repeated preliminary experiments.

In the calibration of the pH meter 303, the calibration of the ultraviolet absorption detector 203 to be described subsequently, the calibration of the atomic absorption spectrometer 102 and the measurement of the concentration of the ingredients in the plating solution, calibration values by the measuring instruments and measured concentration values of the ingredients of the plating solution are affected directly by any abnormality of the pH meter 303, the pH electrodes 302, the atomic absorption spectrometer 102 and the ultraviolet absorption detector 203, any reduction of the ion exchanging ability of the ion exchanger, any abnormality of each metering pump, any leakage from each piping system, occurrence of bubbles in each piping, and the like.

If a calibration value falls outside its corresponding tolerance to be described subsequently, this is notified to the operator by a warning sign. He then makes a decision as to whether the measurement should be repeated or should be stopped. Any false control under an erroneous measurement value is avoided in this manner.

Calibration of the ultraviolet absorption detector 203 is performed in the following manner.

After the standard reducing agent solution is introduced in the sampling loop 661 from the standard reducing agent solution tank 611 by the metering pump 651, the metering pump 652 is driven for a given period of time so that a desired amount of water is charged into the diluting tank 670 from the water tank 617. In the course of the charging of the water, the six-way valve 660 is changed over to simultaneously charge the standard reducing agent solution into the diluting tank 670 from the sampling loop 661 so that the standard reducing agent solution is diluted, for example, fiftyfold in the diluting tank 670. Further, the metering pump 656 is driven to collect the thus-diluted standard solution in the sample loop 667.

The diluted standard solution is delivered through the ion exchange tube 201 and is measured by the ultraviolet absorption detector 203 whose measuring wavelength has been set at 240 nm.

The fiftyfold dilute solution of the standard reducing agent solution is sampled and measured twice.

ACU 401 calculates the average of the two measurement data, followed by a test for any outlier.

The testing for any outliner is conducted based on both the average of the values measured by repeating the measurement twice and the dispersion of the values (the absolute value of their difference). If either one of the average or the dispersion falls outside its corresponding tolerance inputted in advance, this is notified to the operator by a warning sign. The operator then makes a decision as to whether or not the measurement should be repeated again or should be stopped.

Accordingly, with a view toward permitting prompt discovery of any abnormality of these apparatus, these tolerances should each be set at a suitable range in advance through repeated preliminary experiments.

Calibration of the atomic absorption spectrometer 102 is carried out in the following manner.

The calibration is conducted using, as a standard solution, a solution which is obtained by mixing a standard metal component solution of the same composition as the plating solution employed in this example except for the omission of thiourea as a reducing agent with a reducing-agent adding solution composed of a thiourea solution.

The standard gold solution held in the standard metal ingredient tank 610 is diluted, for example, fiftyfold in the diluting tank 670 in the similar manner to the preparation of the standard solution for the ultraviolet absorption detector.

The metering pump 656 is then driven to sample the diluted standard solution into the sampling loop 665. At the same time, the metering pump 654 is also driven to sample the thiourea solution into the sampling loop 663 from the reducing-agent adding solution tank 618. The metering pump 655 is driven for a given period of time. In the course of the drive of the metering pump 655, the six-way valve 664 and the six-way valve 662 are changed over simultaneously, whereby the thiourea solution in the sampling loop 663 and the diluted standard solution in the sampling loop 665 are simultaneously delivered to dilute, for example, 100-fold the mixed solution in the diluting tank 672.

The standard solution is prepared with a composition close to the composition of the preset concentration of the plating solution by adjusting the concentration of the thiourea adding solution and the volume of the sampling loop 663.

The standard solution obtained in the manner described above is sampled by the autosampler 101 and is measured by the atomic absorption spectrometer 102. The standard solution in the diluting tank 672 is then sampled and measured again.

After the measurement, the solenoid valves 671, 673 are opened to dispose the diluted sample. $H_2O$ is then fed by the metering pumps 652,655 so that the diluting tanks 670,672 are washed. The solenoid valve 620 is also opened to drive the metering pump 651, whereby the piping system for the sampling of the standard solution is washed with water.

ACU 401 calculates the average of values obtained by two measurement operations and performs testing of any outlier in a similar manner to the above-described testing of abnormality of the ultraviolet absorption detector.

If an outlier is measured, a warning device gives off a warning sound to notify the operator of the abnormality. The operator then makes a decision as to whether the measurement should be repeated again or the measurement should be stopped.

It is desirable to perform the calibration of the pH meter 303, the atomic absorption spectrometer 102 and the ultraviolet absorption detector 203 at least once a day.

A description will next be made of the measurement of the concentrations of the ingredients in the plating solution and the calculation of amounts to be replenished.

The pH measurement of the plating solution is conducted in the following manner.

For example, the metering pump 651 is driven to deliver the plating solution from the plating tank 61 to the flow cell 301 via the solenoid valve 626, the three-way valve 650 and the six-way valve 660. After stopping the metering pump 651, the pH of the plating solution in the flow cell 301 is measured by the pH electrodes 302. Washing of the piping system is then conducted.

The measurement of the concentration of the reducing agent in the plating solution is performed in the following manner.

For example, the metering pump 651 is driven to cause the plating solution to flow from the plating tank 61 into the sampling loop 661 of the six-way valve 660 via the solenoid valve 626 and the three-way valve 650.

The metering pump 652 is then driven to feed a given amount of water from the water tank 617 to the diluting tank 670. In the course of the feeding of the water, the sample plating solution in the sampling loop 661 is simultaneously fed to the diluting tank 670 so that the plating solution is diluted fiftyfold.

The solenoid valve 681 is opened to allow nitrogen gas to flow into the diluting tank 670 for a short period of time, whereby the solution is agitated there.

The six-way valve 666 is changed over to permit feeding of a portion of the fiftyfold dilute sample from the diluting tank 670 to the sampling loop 667. The metering pump 656 is driven to deliver the dilute sample to the sampling loop 667.

The anion exchange membrane tube 201 is always fed with $H_2O$ at a flow rate of 2 ml/min by means of the metering pump 657. Further, by changing over the six-way valve 666, the dilute sample collected in the sampling loop 667 is delivered to the anion exchange membrane tube 201.

A regenerating solution, for example, a 0.2N KCl solution held in the regenerating solution tank 619 is always fed, for example, at a flow rate of 2 ml/min by the metering pump 658 to the outside of the anion exchange membrane tube 201 of the anion exchanger 202, so that the anion exchange membrane tube 201 is always maintained in its regenerated form, i.e., in a chlorine ion form. When the diluted sample of the plating solution is delivered into the anion exchange membrane tube 201, sulfite ions, thiosulfate ions, gold complexes and the like in the sample are captured on the anion exchange membrane and chlorine ions are eluted instead.

On the other hand, thiourea as a reducing agent is a nonionic substance so that it is delivered together with the eluted chlorine ions to the ultraviolet absorption detector 203 without being captured in the anion exchange membrane tube 201.

The measuring wavelength of the ultraviolet absorption detector 203 is set at 240 nm, at which thiourea shows an absorption. Since chlorine ions do not exhibit any absorption at 240 nm, an absorbance by thiourea alone is measured.

The metering pump 657 is driven again to collect the fiftyfold dilute sample in the sampling loop 667. A similar operation is repeated to measure the absorbance twice.

The measurement of the concentration of the gold ingredient in the plating solution is conducted in the following manner.

The six-way valve 664 is connected to permit feeding of a portion of the fiftyfold dilute sample from the diluting tank 670 to the sampling loop 665. The metering pump 656 is then driven to feed the dilute sample to the sampling loop 665.

The metering pump 655 is then driven for a given period of time, whereby a desired amount of water is charged into the diluting tank 672. In the course of the charging of the water, the six-way valve 664 is changed over to feed the dilute sample from the sampling loop 665 to the diluting tank 672 so that the dilute sample is diluted, for example, 100-fold. The solenoid valve 682 is opened to agitate the resultant mixture with nitrogen gas. A portion of the sample, which is contained in the diluting tank 672 and has been diluted in two stages, is delivered to the atomic absorption spectrometer 102 by the autosampler 101 so that the concentration of gold is measured.

The autosampler 101 is then driven to perform sampling of the diluted solution again, followed by the measurement of the concentration of gold.

After the measurement, the solenoid valves 671,673 are opened to dispose the diluted sample and $H_2O$ is fed by the metering pumps 652,655 to wash the diluting tanks 670,672. In addition, the solenoid valve 625 is opened and the metering pump 651 is driven, whereby the piping system for the sampling of the plating solution is washed with water.

With respect to a proportional calculation of the average of the measurement values of the concentration of the gold ingredient in the plating solution obtained by the two measuring operations or the average of the measurement values of the concentration of the reducing agent in the plating solution to the average of the calibration values obtained by repeating the measurement of the standard solution twice, ACU 401 performs a proportional calculation as represented by formula (1) to calculate the concentrations of gold and thiourea in the plating solution.

Concentration of the ingredient in the plating solution=

$$\frac{\text{measurement value} \times \text{concentration of standard solution}}{\text{Calibration value}} \quad (1)$$

Even if the measuring instruments have a background, the error in the neighborhood of the preset target concentration is extremely small provided that the concentration of the standard solution and the preset target concentration are substantially the same.

Needless to say, the measuring methods of the concentrations are not limited to the methods described above. A calibration curve may be prepared using several standard solutions of different concentrations.

ACU 401 performs testing as to whether or not the thus-calculated concentrations and pH value of the plating solution are within their corresponding tolerances. If any one of the concentrations and pH value is found to fall outside its corresponding tolerance, this is notified to the operator by a warning sign. The operator then makes a decision as to whether the measurement should be repeated or should be stopped. In this manner, any false control under an erroneous measurement value can be avoided.

Further, ACU 401 determines the amount of each ingredient consumed with the progress of the plating from the difference between the calculated concentration of the ingredient in the plating solution and its corresponding preset concentration, and calculates its amount to be replenished. Since the opening times of the associated solenoid valves and the drive time of the associated metering pump must be changed in accordance with the amount to be replenished, these solenoid valves and metering pump are controlled by ACU 401.

The replenishment of the metal component replenisher and the reducing agent replenisher from their tanks 614,615 to each plating tank is performed by opening the solenoid valves 631–635 and driving the metering pump 653.

The replenishing times of gold and thiourea are calculated from the concentrations of gold and thiourea in the replenishers, the amount of the plating solution in each plating tank and the flow rate of the metering pump 653. The solenoid valves 636,637 are successively opened for their corresponding calculated times so that the replenishers are supplied in amounts as needed.

The replenishment of the pH adjusting solution is performed by opening the solenoid valve 638 for a replenishing time preset in accordance with the measurement value of the pH of the plating solution in each plating tank.

Whenever the supply of each replenisher has been completed, the solenoid valve 639 is opened for a prescribed period of time to wash the piping system with water.

ACU 401 employed in this example also has a program which can be used to check the ion exchanging ability of the anion exchanger 202.

If the concentration of thiourea alone in the plating solution exceeds the upper limit of its tolerance, a reduction of the ion exchanging ability of the anion exchanger 202 may be thought of as a possible cause. Here, the operator can check the ion exchanging ability by the following (automatic) operation by selecting the above program.

This program selection can be achieved by sending an instruction through an input device for ACU 401, such as a keyboard (not shown).

Namely, the solenoid valve 624 is opened and the metering pump 651 is driven, whereby the $Na_2S_2O_3$ solution is sampled in the sampling loop 661. After diluting it in the diluting tank 670, the absorbance is measured by the ultraviolet absorbance detector 203 in a similar manner to the measurement of the concentration of thiourea.

If the ion exchanging ability of the anion exchanger 202 is normal, thiosulfate ions are all captured on the anion exchange membrane and chlorine ions are eluted instead. As a result, the ultraviolet absorbance becomes zero. If the ion exchanging ability has been reduced, the thiosulfate ions are delivered either partly or wholly, as they are, to the ultraviolet absorption detector 203 so that a certain degree of absorbance is exhibited. The abnormality can therefore be discovered easily.

Effects of the systems employed in the foregoing example will be described hereinafter.

When a plating solution, which contains reducing ions such as sulfite ions and thiosulfate ions together with metal complexes containing sulfite ions and thiosulfate ions as ligands, is passed through an anion exchange membrane with chlorine ions absorbed thereon, sulfite ions and thiosulfate ions having greater affinity to anion exchange materials are captured on the anion exchange membrane and an equivalent amount of chlorine ions are eluted instead.

In this manner, the reducing ions contained in the plating solution are exchanged with anions which do not disturb the quantitative analysis of the reducing agent contained in the plating solution.

Nevertheless, thiourea is allowed to flow out, as it is, from the anion exchanger because thiourea is not captured on the anion exchange membrane because of its nonionic nature. Since chlorine ions do not show any ultraviolet absorption, the concentration of thiourea can be precisely measured by the ultraviolet absorption detector provided downstream of the anion exchanger.

If the reducing agent is a substance not showing any ultraviolet absorption, for example, like formaldehyde, the provision of an electrochemical quantitative analyzer, for example, a potentiometric titration apparatus in place of the ultraviolet absorption detector makes it possible to calculate the concentration from the amount of an oxidizing agent required for the oxidation of formaldehyde. Here again, chlorine ions do not disturb the measurement. A coulombmetric instrument or a voltametric instrument can also be used as an electrochemical quantitative analyzer.

To conduct the quantitative analysis of the gold ingredient, an analyzer such as a plasma spectrometer can be used instead of the atomic absorption spectrometer. It is however to be noted that plasma spectrometry generally requires a larger measuring instrument than atomic absorption spectrometry.

In particular, the concentration control system employed in Example 3 prevents fluctuations of measurement values—which tend to occur in atomic absorption spectrometry—by using, as a standard solution for the atomic absorption spectrometer, the standard solution containing both the metal ingredient and the reducing agent instead of the metal ingredient alone. The metal ingredient and the reducing agent are mixed together right before each measurement, whereby a standard solution free of phase separation is prepared and a goodaccuracy measurement is hence feasible.

The pH measurement is performed once a day. This can be conducted several times a day.

In Example 3, the measurement by the measuring instruments and the calibration are controlled by the sequencer so that the plating is automated. Control of the measurement by the measuring instruments and the calibration can be conducted using an arithmetic control means without employing such a sequencer.

ACU receives measurement values from the measuring instruments and calibration values and performs the calculation of the concentrations of the ingredients in accordance with the formula (1). From the differences between the thus-determined concentrations of the ingredients in the plating solution and their corresponding preset concentrations, the amounts of the ingredients consumed as a result of the progress of the plating are determined and the amounts of the ingredients to be replenished are calculated accordingly. By periodically supplying the replenishers in amounts corresponding to the consumed amounts from the respective replenisher tanks in accordance with information on the consumed amounts of the individual ingredients, the concentrations of the individual ingredients in the plating solution are always controlled within their corresponding preset constant ranges. As a result, the deposition rate can be maintained constant.

Further, ACU also performs testing for any abnormality with respect to calculation values and measurement values of the concentrations of the ingredients in the plating solution and, depending on the calibration values and measurement values, immediately conducts remeasurement or checking of one or more measuring instruments. The reliability of measurement values has been improved in this manner.

using the concentration control system referred to in Example 3, plating was conducted at a load of 1 $dm^2/L$ for about 20 hours while measuring the pH and the concentrations of gold and thiourea at intervals of 1 hour and supplying the pH adjusting solution and the gold and thiourea replenishers.

During that time, the pH was automatically controlled at 9-9.1, the concentration of gold within a range of $\pm 5\%$ of a preset concentration and the concentration of thiourea within a range of $\pm 3\%$ of a preset concentration. The deposition rate was therefore successfully controlled within a range of 1.0–0.85 $\mu$/hour.

Substantially the same results were also obtained with the concentration control system employed in Example 2.

As has been described above, the concentration control systems according to the present invention can maintain the deposition rate constant in the course of progress of plating so that uniform plating without irregularity can be effected. Namely, the concentration control systems of the present invention can be used as excellent plating systems.

Further, even in the case of various plating solutions other than electroless non-cyanide solutions, the concentration control systems of the present invention can control the concentrations of individual ingredients in such plating solutions provided that the replenishers and standard solution are modified suitably depending on the ingredients of the plating solutions employed. Similarly, the concentration control systems of the present invention can also be incorporated in electroless non-cyanide plating systems.

The concentration control systems employed in Examples 2 and 3 used the atomic absorption spectrometer for the analysis of the concentration of the gold ingredient. It is also possible to provide a measuring means for the concentration of a metal ingredient, which measuring means has an analyzer selected in accordance with the metal ingredient to be measured. Similarly, although the ultraviolet absorption detector was used for the analysis of the concentration of the reducing agent, it is also possible to provide a nonmetal ingredient measuring means such as that capable of measuring the concentration of a non-metal ingredient other than the reducing agent.

Arithmetic control of a concentration control system equipped with a metal ingredient measuring means and a non-metal ingredient measuring means such as those described above can be performed using ACU such as that described in Example 2 or 3.

A concentration control system equipped, for example, with a polarograph as a metal ingredient measuring means and a liquid chromatograph as a non-metal ingredient measuring means can be connected, for example, to a waste water tank such as a factory effluent tank. By measuring, for example, the concentration of cadmium with the metal ingredient measuring means and the concentration of an organic substance such as a ketone with the non-metal ingredient measuring means, the quality of the factory effluent can be controlled. In such use, the standard solution and replenishers to be used should be changed suitably depending on metal ingredient(s) and non-metal ingredient(s) contained in factory effluent.

In addition, the concentration measuring methods according to the present invention can also be used, for example, for the inspection of the quality of water such as river water.

I claim:

1. A method for measuring the concentration of at least one ingredient in an electroless plating solution containing at least one metal ingredient, anions and a reducing agent, which comprises:

measuring the concentration of the reducing agent after replacing the anions with anions of a different type which give no disturbance to the measurement of the concentration of the reducing agent.

2. A method for measuring the concentrations of ingredients in an electroless plating solution containing at least one metal ingredient, anions and a reducing agent, which comprises:

measuring the concentration of the reducing agent after replacing the anions with anions of a different type which give no disturbance to the measurement of the concentration of the reducing agent; and measuring the concentration of the metal ingredient by atomic absorption spectrometry or plasma spectrometry.

3. The method of claim 1 or 2, wherein the concentration of the reducing agent is measured by ultraviolet absorption spectrometry or electrochemical quantitative analysis.

4. The method of claim 1, wherein the metal ingredient is gold ions, anions are sulfate ions and thiosulfate ions, and the reducing agent is thiourea.

5. A method for measuring the concentrations of ingredients in an electroless plating solution containing at least one metal ingredient, anions and a reducing agent, which comprises:

performing, under sequence control according to a sequence program, the measurement of the concentration of the metal ingredient in the plating solution and calibration of a metal-ingredient-concentration measuring means adapted to be used for the measurement of the metal ingredient, the measurement of the concentration of the reducing agent in the plating solution and calibration of a reducing-agent-concentration measuring means adapted to be used for the measurement of the reducing agent, and replacement of the anions with anions of a different type which give no disturbance to the measurement of the concentration of the reducing agent; and determining the concentrations of the metal ingredient and the reducing agent in the plating solution from measurement and calibration values obtained by the measurement and calibration, respectively.

6. A method for adjusting the concentration of an electroless plating solution containing at least one metal ingredient, anions and a reducing agent, which comprises:

replacing the anions with anions of a different type which give no disturbance to measurement of the concentration of the reducing agent;

determining, by computation, consumed amounts of the metal ingredient and the reducing agent from calibration and measurement values which have been obtained by calibration of a metal-ingredient-concentration measuring means adapted to measure the metal ingredient and calibration of a reducing-agent-concentration measuring means adapted to measure the reducing agent and also by measurement of the concentration of the metal ingredient with the metal-ingredient-concentration measuring means and measurement of the concentration of the reducing agent with the reducing-agent-concentration measuring means; and replenishing the plating solution with a replenisher containing the reducing agent and the metal ingredient in amounts corresponding to the consumed amounts, respectively.

7. A system for the measurement of the concentrations of ingredients in an electroless plating solution containing at least one metal ingredient, anions and a reducing agent, which comprises:

an ion exchange means for replacing the anions with anions of a different type which give no disturbance to the measurement of the concentration of the reducing agent;

a means for regenerating the ion exchange means with a solution containing anions of the different type;

a means for measuring the concentration of the reducing agent;

a means for measuring the concentration of the metal ingredient;

a sequence control means for controlling calibration of the reducing-agent-concentration measuring means and the metal-ingredient-concentration measuring means and the measurement of the ingredients in the plating solution by the reducing-agent-concentration measuring means and the metal-ingredient-concentration measuring means; and an arithmetic control means for computing the concentrations of the metal ingredient and the reducing agent in the plating solution from measurement and calibration values obtained by the measurement and the calibration, respectively.

8. A system for the adjustment of the concentrations of ingredients in an electroless plating solution containing at least one metal ingredient, anions and a reducing agent, which comprises:

an ion exchange means for replacing the anions with anions of a different type which give no disturbance to the measurement of the concentration of the reducing agent;

a means for regenerating the ion exchange means with a solution containing anions of the different type;

a means for measuring the concentration of the reducing agent;

a means for measuring the concentration of the metal ingredient;

a sequence control means for controlling operations of the reducing-agent-concentration measuring means and the metal-ingredient-concentration measuring means;

an arithmetic control means having a means for calculating consumed amounts of the reducing agent and the metal ingredient from the differences between the measured concentrations of the reducing agent and the metal ingredient and their corresponding original concentrations and a means for feeding a replenisher containing the reducing agent and the metal ingredient in amounts corresponding to the consumed amounts, respectively.

9. An electroless plating system suitable for use in conducting electroless plating in an electroless plating solution containing at least one metal ingredient, anions and a reducing agent, which comprises:

a plating bath, a means for measuring the concentration of the electroless plating solution, a means for replenishing the electroless plating solution, a sequence control means, and an arithmetic control means; wherein, the plating-solution-concentration measuring means has an ion exchange means for replacing the anions with anions of a different type which give no disturbance to the measurement of the reducing agent, a means for measuring the concentration of the reducing agent and a means for measuring the concentration of the metal ingredient, the sequence control means controls operation of the plating-solution-concentration measuring means, and the arithmetic control means has a means for calculating consumed amounts of the reducing agent and the metal ingredient from the differences between the measured concentrations of the reducing agent and the metal ingredient and their corresponding original concentrations and a means for feeding a replenisher, which contains the reducing agent and the metal ingredient in amounts corresponding to the respective consumed amounts, from the plating solution replenishing means to the plating bath.

10. A concentration control system comprising:

a means for measuring the concentration of a metal ingredient contained in a solution;

a means for measuring the concentration of a non-metal ingredient contained in the solution; and a means having a function of controlling operations of the metal-ingredient-concentration measuring means and the non-metal-ingredient-concentration measuring means and a function of feeding a replenisher containing the metal ingredient in an amount corresponding to a consumed amount of the metal ingredient on the basis of the difference between the measured concentration of the metal ingredient and its original concentration and another replenisher containing the non-metal ingredient in an amount corresponding to a consumed amount of the non-metal ingredient on the basis of the difference between the measured concentration of the non-metal ingredient and its preset concentration.

11. The concentration control system of claim 10, wherein the metal-ingredient-concentration measuring means in an atomic absorption spectrometer or a plasma spectrometer.

12. The concentration control system of claim 10 or 11, wherein the non-metal-concentration measuring means comprises an anion exchange apparatus and an ultraviolet absorption detector or an electrochemical quantitative analyzer.

* * * * *

UNITED STATES PATENT AND TRADEMARK OFFICE

CERTIFICATE OF CORRECTION

PATENT NO. : 5,106,413

DATED : April 21, 1992

INVENTOR(S) : Hiroko Takehawa

It is certified that error appears in the above-identified patent and that said Letters Patent is hereby corrected as shown below:

On the Title Page, left-hand column, after "[75] Inventor:" delete, "Hiroko Takehawa" and insert -- Hiroko Takehara --.

and Item [19]

Signed and Sealed this

Tenth Day of August, 1993

*Attest:*

Michael K. Kirk

MICHAEL K. KIRK

*Attesting Officer*

*Acting Commissioner of Patents and Trademarks*